US009403069B2

(12) United States Patent
Boyd et al.

(10) Patent No.: US 9,403,069 B2
(45) **Date of Patent: *Aug. 2, 2016**

(54) GOLF CLUB HEAD OR OTHER BALL STRIKING DEVICE HAVING IMPACT-INFLUENCING BODY FEATURES

(71) Applicant: Nike, Inc., Beaverton, OR (US)

(72) Inventors: Robert Boyd, Flower Mound, TX (US); Andrew G. V. Oldknow, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/797,124

(22) Filed: Mar. 12, 2013

(65) Prior Publication Data

US 2013/0324281 A1 Dec. 5, 2013

Related U.S. Application Data

(60) Provisional application No. 61/653,937, filed on May 31, 2012.

(51) Int. Cl.
*A63B 53/04* (2015.01)
*A63B 53/02* (2015.01)
(Continued)

(52) U.S. Cl.
CPC ..... *A63B 53/0466* (2013.01); *A63B 49/06* (2013.01); *A63B 53/02* (2013.01); *A63B 53/04* (2013.01); *A63B 59/0088* (2013.01); *A63B 53/0487* (2013.01); *A63B 2053/022* (2013.01); *A63B 2053/045* (2013.01);
(Continued)

(58) Field of Classification Search
CPC .... A63B 53/0466; A63B 53/02; A63B 53/04; A63B 53/065
USPC ..... 473/345, 346, 307–308, 244–248
See application file for complete search history.

(56) References Cited

U.S. PATENT DOCUMENTS

| | | | |
|---|---|---|---|
| 1,135,621 | A | 4/1915 | Roberts |
| 1,676,518 | A | 7/1928 | Boles |
| 1,697,846 | A | 1/1929 | Anderson |

(Continued)

FOREIGN PATENT DOCUMENTS

| | | | |
|---|---|---|---|
| EP | 2377586 | A2 | 10/2011 |
| JP | H0639036 | U | 5/1994 |

(Continued)

OTHER PUBLICATIONS

ISR & WO mailed Dec. 18, 2012 from PCT Application No. PCT/US2012/057490.

*Primary Examiner* — Stephen Blau
(74) *Attorney, Agent, or Firm* — Banner & Witcoff, Ltd.

(57) ABSTRACT

A ball striking device has a face with a striking surface and a body extending rearwardly from the outer periphery of the face. A channel extends across at least a portion of the sole, and includes a trough defined between front and rear edges and extending in a heel-toe direction. The device further has internal interconnection structure for connection of a shaft to the head. The device may have a hosel connected to the body proximate the heel, with the hosel having the internal interconnection structure adapted for connection of the shaft to the hosel. A bore or access opening may be provided that intersects the channel, to access the interconnecting structure. The device may further include one or more stiffening ribs on the sole.

34 Claims, 15 Drawing Sheets

(51) Int. Cl.
*A63B 59/00* (2015.01)
*A63B 49/06* (2006.01)

(52) U.S. Cl.
CPC *A63B 2053/0433* (2013.01); *A63B 2053/0491* (2013.01); *A63B 2209/00* (2013.01); *A63B 2209/023* (2013.01)

(56) References Cited

U.S. PATENT DOCUMENTS 1,705,997 A 3/1929 Williams
1,854,548 A 4/1932 Hunt
2,691,525 A 10/1954 Callaghan, Sr.
3,084,940 A 4/1963 Cissel
3,810,631 A 5/1974 Braly
3,997,170 A 12/1976 Goldberg
4,322,083 A 3/1982 Imai
4,398,965 A 8/1983 Campau
4,438,931 A 3/1984 Motomiya
4,754,974 A 7/1988 Kobayashi
4,878,666 A 11/1989 Hosoda
5,067,715 A 11/1991 Schmidt et al.
5,076,585 A 12/1991 Bouquet
5,193,810 A 3/1993 Antonious
5,213,328 A 5/1993 Long et al.
5,221,086 A 6/1993 Antonious
5,301,941 A 4/1994 Allen
5,316,305 A 5/1994 McCabe
5,330,187 A 7/1994 Schmidt et al.
5,419,556 A 5/1995 Take
5,451,056 A * 9/1995 Manning ..... 473/328
5,472,201 A 12/1995 Aizawa et al.
5,472,203 A 12/1995 Schmidt et al.
5,480,152 A 1/1996 Schmidt et al.
5,511,786 A 4/1996 Antonious
5,538,245 A 7/1996 Moore
5,564,705 A 10/1996 Kobayashi et al.
5,603,668 A 2/1997 Antonious
5,616,088 A 4/1997 Aizawa et al.
5,735,754 A 4/1998 Antonious
5,749,795 A 5/1998 Schmidt et al.
5,803,829 A 9/1998 Hayashi
5,873,791 A 2/1999 Allen
5,888,148 A 3/1999 Allen
6,042,486 A 3/2000 Gallagher
6,074,308 A 6/2000 Domas
6,086,485 A 7/2000 Hamada et al.
6,120,384 A 9/2000 Drake
6,299,546 B1 10/2001 Wang
6,344,000 B1 2/2002 Hamada et al.
6,344,001 B1 2/2002 Hamada et al.
6,348,013 B1 2/2002 Kosmatka
6,354,961 B1 3/2002 Allen
6,422,951 B1 7/2002 Burrows
6,447,405 B1 9/2002 Chen
6,530,847 B1 3/2003 Antonious
6,575,854 B1 6/2003 Yang et al.
6,602,149 B1 8/2003 Jacobson
6,616,547 B2 9/2003 Vincent et al.
D482,089 S 11/2003 Burrows
D482,090 S 11/2003 Burrows
D482,420 S 11/2003 Burrows
D484,208 S 12/2003 Burrows
D501,036 S 1/2005 Burrows
6,855,068 B2 2/2005 Antonious
6,887,165 B2 5/2005 Tsurumaki
7,086,964 B2 8/2006 Chen et al.
7,134,971 B2 11/2006 Franklin et al.
7,278,926 B2 10/2007 Frame
7,294,064 B2 11/2007 Tsurumaki et al.
7,396,293 B2 7/2008 Soracco
D588,223 S 3/2009 Kuan
7,500,924 B2 3/2009 Yokota
7,530,901 B2 5/2009 Imamoto et al.
7,572,193 B2 8/2009 Yokota
7,632,193 B2 12/2009 Thielen
7,641,569 B2 1/2010 Best et al.
7,682,264 B2 3/2010 Hsu et al.
7,749,101 B2 7/2010 Imamoto et al.
7,824,277 B2 11/2010 Bennett et al.
7,857,711 B2 12/2010 Shear
7,867,105 B2 1/2011 Moon
7,896,753 B2 3/2011 Boyd et al.
7,988,565 B2 8/2011 Abe
8,016,694 B2 9/2011 Llewellyn et al.
8,177,661 B2 5/2012 Beach et al.
8,182,364 B2 5/2012 Cole et al.
8,235,841 B2 8/2012 Stites et al.
8,235,844 B2 8/2012 Albertsen et al.
8,241,143 B2 8/2012 Albertsen et al.
8,241,144 B2 8/2012 Albertsen et al.
8,257,195 B1 9/2012 Erickson
8,257,196 B1 9/2012 Abbott et al.
8,277,337 B2 10/2012 Shimazaki
8,328,659 B2 12/2012 Shear
D675,692 S 2/2013 Oldknow et al.
D678,964 S 3/2013 Oldknow et al.
D678,965 S 3/2013 Oldknow et al.
D678,968 S 3/2013 Oldknow et al.
D678,969 S 3/2013 Oldknow et al.
D678,970 S 3/2013 Oldknow et al.
D678,971 S 3/2013 Oldknow et al.
D678,972 S 3/2013 Oldknow et al.
D678,973 S 3/2013 Oldknow et al.
8,403,771 B1 3/2013 Rice et al.
D679,354 S 4/2013 Oldknow et al.
8,430,763 B2 4/2013 Beach et al.
8,435,134 B2 5/2013 Tang et al.
8,517,855 B2 * 8/2013 Beach et al. ..... 473/307
8,517,860 B2 8/2013 Albertsen et al.
8,529,368 B2 9/2013 Rice et al.
8,562,453 B2 * 10/2013 Sato ..... 473/288
8,579,728 B2 11/2013 Morales et al.
8,591,351 B2 11/2013 Albertsen et al.
D697,152 S 1/2014 Harbert et al.
8,628,433 B2 1/2014 Stites et al.
8,632,419 B2 1/2014 Tang et al.
8,641,555 B2 2/2014 Stites et al.
8,690,704 B2 4/2014 Thomas
8,696,491 B1 4/2014 Myers
8,702,531 B2 4/2014 Boyd et al.
D707,768 S 6/2014 Oldknow et al.
D707,769 S 6/2014 Oldknow et al.
D707,773 S 6/2014 Oldknow et al.
D708,281 S 7/2014 Oldknow et al.
8,821,312 B2 9/2014 Burnett et al.
8,827,831 B2 9/2014 Burnett et al.
8,834,289 B2 9/2014 de la Cruz et al.
8,834,290 B2 9/2014 Bezilla et al.
8,845,454 B2 9/2014 Boyd et al.
D714,893 S 10/2014 Atwell
8,888,607 B2 11/2014 Harbert et al.
D722,122 S 2/2015 Greensmith
8,986,133 B2 3/2015 Bennett et al.
2002/0183134 A1 12/2002 Allen et al.
2003/0013545 A1 1/2003 Vincent et al.
2004/0023729 A1 2/2004 Nagai et al.
2004/0121852 A1 6/2004 Tsurumaki
2004/0180730 A1 9/2004 Franklin et al.
2004/0192463 A1 9/2004 Tsurumaki et al.
2005/0049075 A1 3/2005 Chen et al.
2005/0070371 A1 3/2005 Chen et al.
2005/0096151 A1 5/2005 Hou et al.
2005/0124435 A1 6/2005 Gambetta et al.
2005/0227781 A1 10/2005 Huang et al.
2005/0266933 A1 12/2005 Galloway
2006/0073910 A1 4/2006 Imamoto et al.
2006/0122004 A1 6/2006 Chen et al.
2006/0189407 A1 8/2006 Soracco
2007/0021234 A1 1/2007 Tsurumaki et al.
2007/0026961 A1 2/2007 Hou
2007/0049400 A1 3/2007 Imamoto et al.
2007/0049415 A1 3/2007 Shear
2007/0049417 A1 3/2007 Shear

(56) References Cited

U.S. PATENT DOCUMENTS

| | | | | |
|---|---|---|---|---|
| 2007/0117648 | A1 | 5/2007 | Yokota | |
| 2009/0264214 | A1 | 10/2009 | De La Cruz et al. | |
| 2009/0286611 | A1 | 11/2009 | Beach et al. | |
| 2009/0318245 | A1 | 12/2009 | Yim et al. | |
| 2010/0016095 | A1 | 1/2010 | Burnett et al. | |
| 2010/0029408 | A1 | 2/2010 | Abe | |
| 2010/0035701 | A1 | 2/2010 | Kusumoto | |
| 2010/0197423 | A1 | 8/2010 | Thomas et al. | |
| 2010/0197426 | A1 | 8/2010 | De La Cruz et al. | |
| 2010/0234127 | A1 | 9/2010 | Snyder et al. | |
| 2011/0021284 | A1 | 1/2011 | Stites et al. | |
| 2011/0098127 | A1 | 4/2011 | Yamamoto | |
| 2011/0195798 | A1 | 8/2011 | Sander et al. | |
| 2011/0218053 | A1 | 9/2011 | Tang et al. | |
| 2011/0294599 | A1 | 12/2011 | Albertsen et al. | |
| 2012/0083362 | A1 | 4/2012 | Albertsen et al. | |
| 2012/0083363 | A1 | 4/2012 | Albertsen et al. | |
| 2012/0122601 | A1* | 5/2012 | Beach et al. | 473/248 |
| 2012/0142447 | A1 | 6/2012 | Boyd et al. | |
| 2012/0142452 | A1 | 6/2012 | Burnett et al. | |
| 2012/0165110 | A1 | 6/2012 | Cheng | |
| 2012/0165111 | A1 | 6/2012 | Cheng | |
| 2012/0196701 | A1 | 8/2012 | Stites et al. | |
| 2012/0202615 | A1* | 8/2012 | Beach et al. | 473/338 |
| 2012/0270676 | A1 | 10/2012 | Burnett et al. | |
| 2012/0302366 | A1 | 11/2012 | Murphy | |
| 2013/0065705 | A1 | 3/2013 | Morales et al. | |
| 2013/0102410 | A1* | 4/2013 | Stites et al. | 473/335 |
| 2013/0165254 | A1 | 6/2013 | Rice et al. | |
| 2013/0210542 | A1 | 8/2013 | Harbert et al. | |
| 2013/0324284 | A1 | 12/2013 | Stites et al. | |
| 2014/0080629 | A1* | 3/2014 | Sargent et al. | 473/336 |
| 2015/0217167 | A1 | 8/2015 | Frame et al. | |

FOREIGN PATENT DOCUMENTS

| | | | |
|---|---|---|---|
| JP | 06190088 | A | 7/1994 |
| JP | 3035480 | U | 3/1997 |
| JP | 11114102 | | 6/2000 |
| JP | 2000197718 | | 7/2000 |
| JP | 2002052099 | | 2/2002 |
| JP | 2002248183 | A | 9/2002 |
| JP | 2003093554 | | 4/2003 |
| JP | 2004174224 | A | 6/2004 |
| JP | 2004313762 | | 11/2004 |
| JP | 2004351054 | A | 12/2004 |
| JP | 2004351173 | A | 12/2004 |
| JP | 2006231063 | | 9/2006 |
| JP | 2008515560 | A | 5/2008 |
| JP | 2008200118 | | 9/2008 |
| JP | 2010279847 | A | 12/2010 |
| JP | 2011024999 | A | 2/2011 |
| WO | 99/20358 | | 4/1999 |
| WO | 01/49376 | | 7/2001 |
| WO | 2014070343 | A1 | 5/2014 |

* cited by examiner

GOLF CLUB HEAD OR OTHER BALL STRIKING DEVICE HAVING IMPACT-INFLUENCING BODY FEATURES

CROSS-REFERENCE TO RELATED APPLICATION

The present application claims priority to is a non-provisional of U.S. Provisional Application No. 61/653,937, filed May 31, 2012, which application is incorporated by reference herein in its entirety and made part hereof.

TECHNICAL FIELD

The invention relates generally to golf club heads and other ball striking devices that include impact influencing body features. Certain aspects of this invention relate to golf club heads and other ball striking devices that have a compression channel extending across at least a portion of the sole.

BACKGROUND

Golf clubs and many other ball striking devices may have various face and body features, as well as other characteristics, that can influence the use and performance of the device. For example, users may wish to have improved impact properties, such as increased coefficient of restitution (COR) in the face and/or increased size of the area of greatest response or COR (also known as the "hot zone") of the face. The present devices and methods are provided to address at least some of these problems and other problems, and to provide advantages and aspects not provided by prior ball striking devices. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the invention relate to a ball striking device, such as a golf club head, having a face with a striking surface configured for striking a ball, the face being defined by an outer periphery, and a body connected to the face and extending rearwardly from the outer periphery of the face, with the body having a sole configured to face a playing surface and a crown opposite the sole, and a hosel connected to the body proximate the heel, with the hosel having internal interconnection structure adapted for connection of a shaft to the hosel. The device also has an inwardly recessed channel extending across at least a portion of the sole, and the channel includes an inwardly recessed trough defined between a front edge and a rear edge extending in the heel-toe direction. The device further has an access opening extending through the sole and intersecting the channel, with the access opening providing access to the internal interconnection structure of the hosel. The access opening may influence the flexibility of the channel.

According to one aspect, the internal interconnection structure is adapted for connection of the shaft to the hosel in an adjustable configuration.

According to another aspect, the access opening may be located between the front edge and the rear edge of the channel and/or may intersect the heel portion of the channel.

According to a further aspect, the head may include a stiffening rib on the sole, spaced rearwardly from the channel, where the stiffening rib increases the stiffness of the sole. The stiffening rib may project inwardly into the body.

According to yet another aspect, the rear edge of the channel may be spaced rearwardly a greater distance from the outer periphery of the face at a center portion of the channel as compared to a point proximate the toe. In this configuration, the access opening may intersect the heel portion of the channel, and the internal interconnection structure may be adapted for connection of the shaft to the hosel in an adjustable configuration.

Additional aspects of the invention relate to a ball striking device that includes a face having a striking surface configured for striking a ball and being defined by an outer periphery, a body connected to the face and extending rearwardly from the outer periphery of the face, the body having a sole configured to face a playing surface, a crown opposite the sole, a heel, and a toe, and internal interconnection structure adapted for connection of a shaft to the body in an adjustable configuration. The device also has a channel extending across at least a portion of the sole of the body, where the channel is defined between a front edge and a rear edge extending in the heel-toe direction and is inwardly recessed between the front and rear edges. The device further has an access opening within the sole, the access opening providing access to the internal interconnection structure, where the access opening is in communication with the channel. The device may include any of the components and features described above.

According to one aspect, the access opening may be located between the front edge and the rear edge of the channel and/or may be in communication with a heel portion of the channel.

According to another aspect, the rear edge of the channel is spaced rearwardly a greater distance from the outer periphery of the face at a center portion of the channel as compared to a point proximate the toe. In this configuration, the access opening may be in communication with the heel portion of the channel may be is located between the front edge and the rear edge of the channel.

Further aspects of the invention relate to a ball striking device that includes a face having a striking surface configured for striking a ball and being defined by an outer periphery, a body connected to the face and extending rearwardly from the outer periphery of the face, with the body having a sole configured to face a playing surface, a crown opposite the sole, a heel, and a toe, and internal interconnection structure adapted for connection of a shaft to the body. The device may also include a channel extending across at least a portion of the sole of the body, where the channel is defined between a front edge and a rear edge extending in the heel-toe direction and is inwardly recessed between the front and rear edges. The device may further include an access opening extending through the sole and intersecting the channel, where the access opening providing access to the internal interconnection structure. Still further, the device may include a stiffening rib on the sole, spaced rearwardly from the channel, where the stiffening rib increases the stiffness of the sole. The device may include any of the components and features described above.

According to one aspect, the device further includes multiple stiffening ribs on the sole, spaced rearwardly from the channel, where each stiffening rib increases the stiffness of the sole. Each stiffening rib may project inwardly into the body.

According to another aspect, the device may further include a hosel connected to the body proximate the heel. The hosel contains the internal interconnection structure and is configured for connection of the shaft, and the access opening intersects a heel portion of the channel. The internal interconnection structure may be adapted for connection of the shaft to the hosel in an adjustable configuration. Further, the rear edge of the channel may be spaced rearwardly a greater distance from the outer periphery of the face at a center portion of the channel as compared to a point proximate the toe.

According to a further aspect, at least a portion of the channel may have a greater flexibility than the stiffening rib. In one configuration, the center portion of the channel has a greater flexibility than the stiffening rib.

Still further aspects of the invention relate to golf clubs that include a golf club head or other device as described above and a shaft connected to the head.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which.

DETAILED DESCRIPTION

Figure 1:
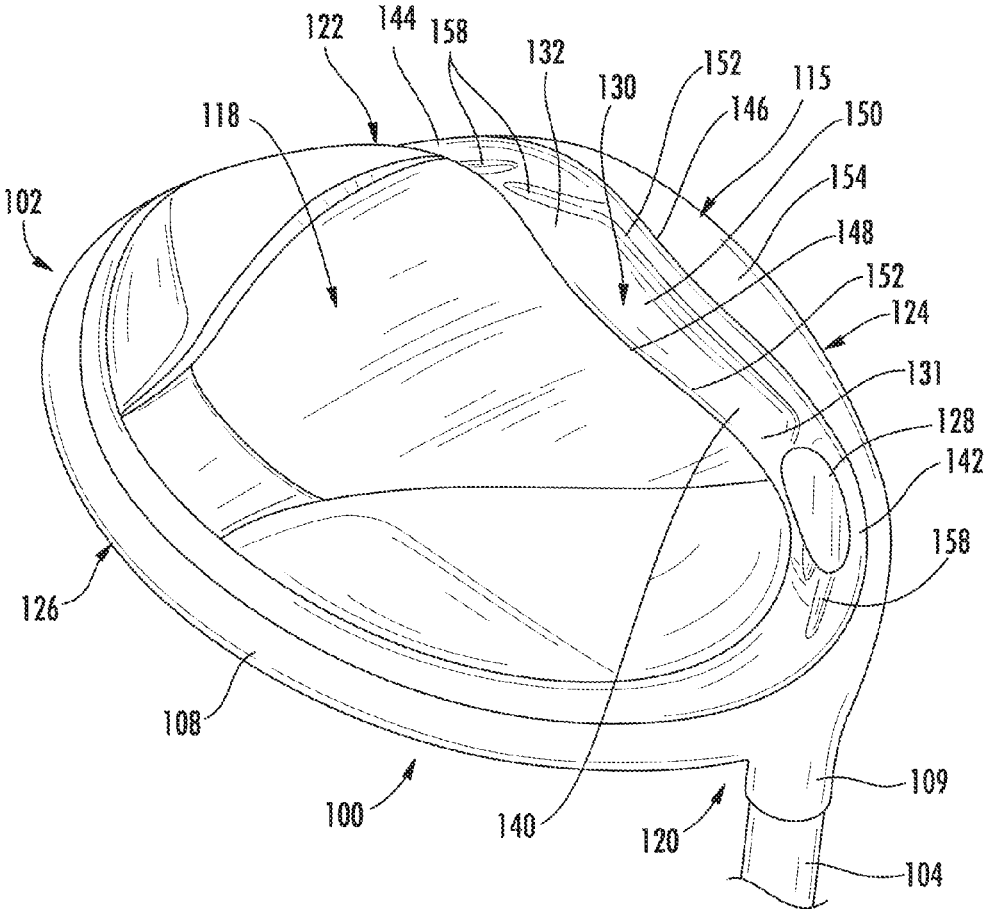
FIG. 1 is a bottom rear perspective view of one embodiment of a ball striking device according to aspects of the present invention, in the form of a golf driver.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" (or "head") means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft member, and it may be attached to the shaft in some manner.

The term "shaft" includes the portion of a ball striking device (if any) that the user holds during a swing of a ball striking device.

"Integral joining technique" means a technique for joining two pieces so that the two pieces effectively become a single, integral piece, including, but not limited to, irreversible joining techniques, such as adhesively joining, cementing, welding, brazing, soldering, or the like, where separation of the joined pieces cannot be accomplished without structural damage thereto.

"Generally parallel" means that a first line, segment, plane, edge, surface, etc. is approximately (in this instance, within 5%) equidistant from with another line, plane, edge, surface, etc., over at least 50% of the length of the first line, segment, plane, edge, surface, etc.

In general, aspects of this invention relate to ball striking devices, such as golf club heads, golf clubs, and the like. Such ball striking devices, according to at least some examples of the invention, may include a ball striking head with a ball striking surface. In the case of a golf club, the ball striking surface is a substantially flat surface on one face of the ball striking head. Some more specific aspects of this invention relate to wood-type golf clubs and golf club heads, including fairway woods, hybrid clubs, and the like, as well as other wood-type golf clubs such as drivers, although aspects of this invention also may be practiced on iron-type clubs, putters, and other club types as well.

According to various aspects of this invention, the ball striking device may be formed of one or more of a variety of materials, such as metals (including metal alloys), ceramics, polymers, composites (including fiber-reinforced composites), and wood, and may be formed in one of a variety of configurations, without departing from the scope of the invention. In one illustrative embodiment, some or all components of the head, including the face and at least a portion of the body of the head, are made of metal (the term "metal," as used herein, includes within its scope metal alloys). It is understood that the head may contain components made of several different materials, including carbon-fiber composites, polymer materials, and other components. Additionally, the components may be formed by various forming methods. For example, metal components (such as titanium, aluminum, titanium alloys, aluminum alloys, steels (including stainless steels), and the like) may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques. In a further example, polymer components, such as high strength polymers, can be manufactured by polymer processing techniques, such as various molding and casting techniques and/or other known techniques.

The various figures in this application illustrate examples of ball striking devices according to this invention. When the same reference number appears in more than one drawing, that reference number is used consistently in this specification and the drawings refer to the same or similar parts throughout.

At least some examples of ball striking devices according to this invention relate to golf club head structures, including heads for wood-type golf clubs, such as drivers, fairway woods and hybrid clubs, as well as other types of wood-type clubs, long iron clubs (e.g., driving irons, zero irons through five irons, and hybrid type golf clubs), short iron clubs (e.g., six irons through pitching wedges, as well as sand wedges, lob wedges, gap wedges, and/or other wedges), and putters. Such devices may include a one-piece construction or a multiple-piece construction. Example structures of ball striking devices according to this invention will be described in detail below in conjunction with FIGS. 1-4, which illustrate one illustrative embodiment of a ball striking device 100 in the form of a wood-type golf club (e.g. a driver), although it is understood that similar configurations may be used for other wood-type clubs, including a fairway wood (e.g., a 3-wood, 5-wood, 7-wood, etc.), as illustrated in FIGS. 6-9, or a hybrid club, as illustrated in FIGS. 10-13.

Figure 2:
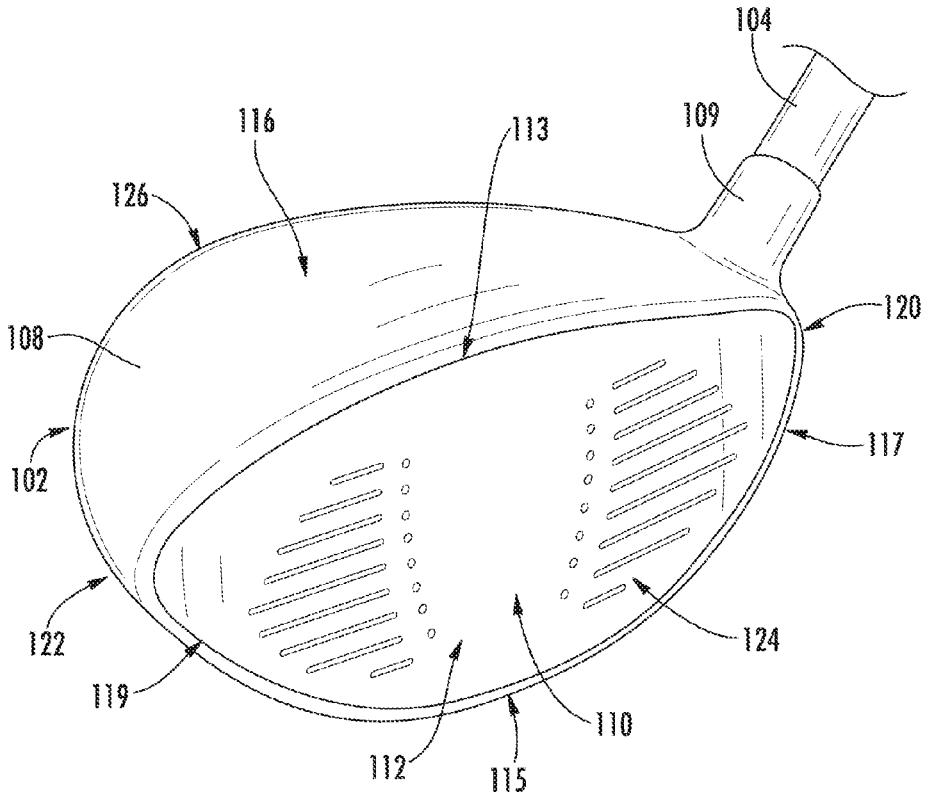
FIG. 2 is a top front perspective view of the ball striking device of FIG. 1.
Figure 3:
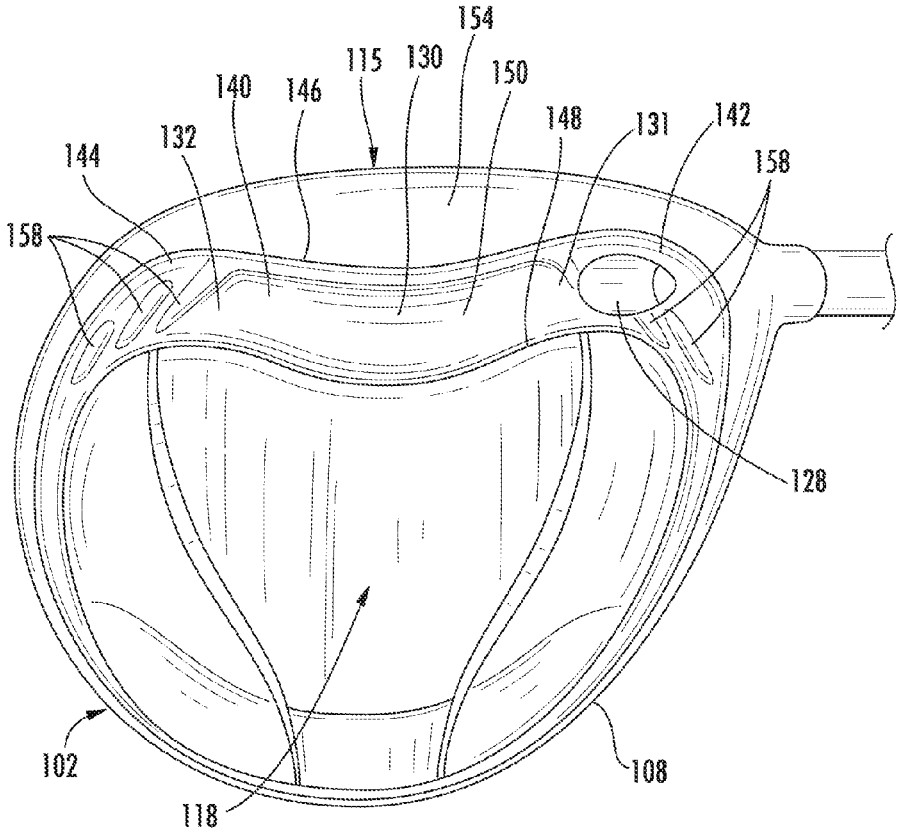
FIG. 3 is a bottom view of the ball striking device of FIG. 1.
Figure 4:
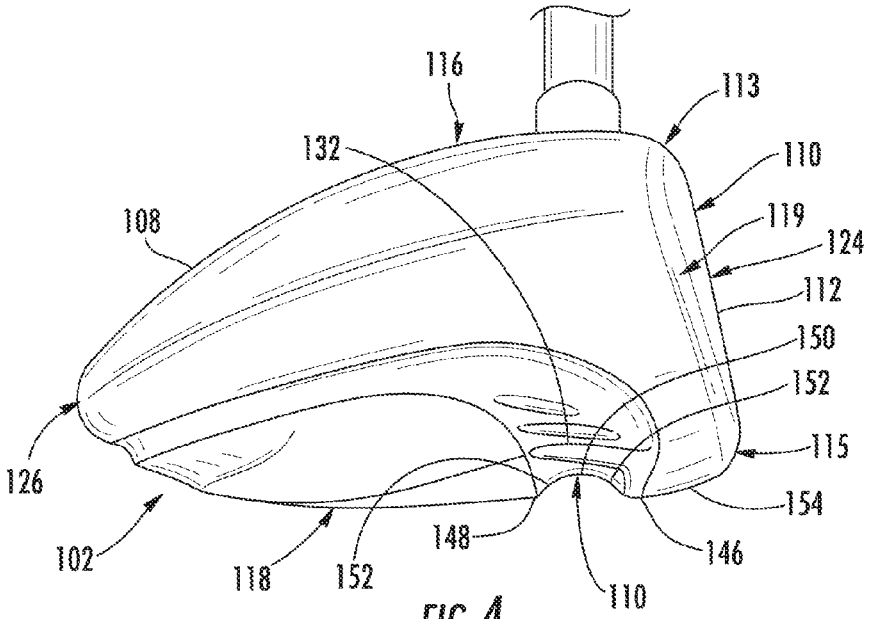
FIG. 4 is a side view of the ball striking device of FIG. 1.

The golf club 100 shown in FIGS. 1-4 includes a ball striking head 102 configured to strike a ball in use and a shaft 104 connected to the ball striking head 102 and extending therefrom. FIGS. 1-4 illustrate one embodiment of a ball striking head 102 in the form of a golf club head 102 that has a face 112 connected to a body 108, with a hosel 109 extending therefrom and a shaft 104 connected to the hosel 109. Any desired hosel and/or head/shaft interconnection structure may be used without departing from this invention, including conventional hosel or other head/shaft interconnection structures as are known and used in the art, or an adjustable, releasable, and/or interchangeable hosel or other head/shaft interconnection structure such as those shown and described in U.S. Pat. No. 6,890,269 dated May 10, 2005, in the name of Bruce D. Burrows, U.S. Published Patent Application No. 2009/0011848, filed on Jul. 6, 2007, in the name of John Thomas Stites, et al., U.S. Published Patent Application No. 2009/0011849, filed on Jul. 6, 2007, in the name of John Thomas Stites, et al., U.S. Published Patent Application No. 2009/0011850, filed on Jul. 6, 2007, in the name of John Thomas Stites, et al., and U.S. Published Patent Application No. 2009/0062029, filed on Aug. 28, 2007, in the name of John Thomas Stites, et al., all of which are incorporated herein by reference in their entireties. The head 102 may have an opening or other access 128 for the adjustable hosel 109 features that extends through the sole 118 and is in communication with the channel 140 and/or intersects the channel 140, as seen in FIGS. 1 and 3.

For reference, the head 102 generally has a top or crown 116, a bottom or sole 118, a heel 120 proximate the hosel 109, a toe 122 distal from the hosel 109, a front 124, and a back or rear 126, as shown in FIGS. 1-4. The shape and design of the head 102 may be partially dictated by the intended use of the golf club 100. For example, it is understood that the sole 118 is configured to face the playing surface in use. With clubs that are configured to be capable of hitting a ball resting directly on the playing surface, such as a fairway wood, hybrid, iron, etc., the sole 118 may contact the playing surface in use, and features of the club may be designed accordingly. In the club 100 shown in FIGS. 1-4, the head 102 has an enclosed volume, as the club 100 is a wood-type club designed for use as a driver, intended to hit the ball long distances. In other applications, such as for a different type of golf club, the head 102 may be designed to have different dimensions and configurations. For example, when configured as a driver, the club head 102 may have a volume of at least 400 cc, and in some structures, at least 450 cc, or even at least 460 cc. If instead configured as a fairway wood (e.g., FIGS. 6-9), the head may have a volume of 120 cc to 230 cc, and if configured as a hybrid club (e.g., FIGS. 10-13), the head may have a volume of 85 cc to 140 cc. Other appropriate sizes for other club heads may be readily determined by those skilled in the art. The club head 102 loft angle also may vary, e.g., depending on the shot distance desired for the club head 102.

The body 108 of the head 102 can have various different shapes, including a rounded shape, as in the head 102 shown in FIGS. 1-4, a squared or rectangular shape, or any other of a variety of other shapes. It is understood that such shapes may be configured to distribute weight in any desired, manner, e.g., away from the face 112 and/or the geometric/volumetric center of the head 102, in order to create a lower center of gravity and/or a higher moment of inertia.

In the illustrative embodiment illustrated in FIGS. 1-4, the head 102 has a hollow structure defining an inner cavity (not shown) (e.g., defined by the face 112 and the body 108) with a plurality of inner surfaces defined therein. In one embodiment, the inner cavity may be filled with air. However, in other embodiments, the head 102 could be filled with another material, such as foam. In still further embodiments, the solid materials of the head may occupy a greater proportion of the volume, and the head may have a smaller cavity or no inner cavity at all. It is understood that the inner cavity may not be completely enclosed in some embodiments.

The face 112 is located at the front 124 of the head 102 and has a ball striking surface (or striking surface) 110 located thereon and an inner surface (not shown) opposite the ball striking surface 110, as illustrated in FIG. 2. The ball striking surface 110 is typically an outer surface of the face 112 configured to face a ball in use and is adapted to strike the ball when the golf club 100 is set in motion, such as by swinging. As shown, the ball striking surface 110 is relatively flat, occupying at least a majority of the face 112. The face 112 has an outer periphery formed of a plurality of outer or peripheral edges, including a top edge 113, a bottom edge 115, and lateral edges (including heel edge 117 and toe edge 119). The edges of the face 112 may be defined as the boundaries of an area of the face 112 that is specifically designed to contact the ball in use, and may be recognized as the boundaries of an area of the face 112 that is intentionally shaped and configured to be suited for ball contact. The face 112 may include some curvature in the top to bottom and/or heel to toe directions (e.g., bulge and roll characteristics), as is known and is conventional in the art. In other embodiments, the surface 110 may occupy a different proportion of the face 112, or the body 108 may have multiple ball striking surfaces 110 thereon. In the illustrative embodiment shown in FIGS. 1-4, the ball striking surface 110 is inclined with respect to the ground or contact surface (i.e., at a loft angle), to give the ball a desired lift and spin when struck. In other illustrative embodiments, the ball striking surface 110 may have a different incline or loft angle, to affect the trajectory of the ball. Additionally, the face 112 may have a variable thickness and also may have one or more internal or external inserts and/or supports in some embodiments.

It is understood that the face 112, the body 108, and/or the hosel 109 can be formed as a single piece or as separate pieces that are joined together. The face 112 may be formed as a face plate member with the body 108 being partially or wholly formed by one or more separate pieces connected to the face plate member. The face 112 may alternately be formed as part of a face frame member with the body 108 being partially or wholly formed by one or more separate pieces connected to the face frame member, with a wall or walls extending rearward from the edges of the face 112 (these rearward extending walls also may be referred to as a "return portion"). This configuration may also be known as a "cup face" structure in some configurations. The face frame member may also have an L-shaped configuration. Additionally, at least a portion of the body 108 may be formed as a separate piece or pieces joined to the wall(s) of the face frame member, such as by a backbody member attached to the cup face structure, composed of a single piece or multiple pieces. These pieces may be connected by an integral joining technique, such as welding, cementing, or adhesively joining Other known techniques for joining these parts can be used as well, including many mechanical joining techniques, including releasable mechanical engagement techniques. If desired, the hosel 109 may be integrally formed as part of the face frame member. Further, a gasket (not shown) may be included between the cup face structure and the backbody member.

The golf club 100 may include a shaft 104 connected to or otherwise engaged with the ball striking head 102 as shown in FIG. 2. The shaft 104 is adapted to be gripped by a user to swing the golf club 100 to strike the ball. The shaft 104 can be formed as a separate piece connected to the head 102, such as by connecting to the hosel 109, as shown in FIG. 1. In other illustrative embodiments, at least a portion of the shaft 104 may be an integral piece with the head 102, and/or the head 102 may not contain a hosel 109 or may contain an internal hosel structure. Still further embodiments are contemplated without departing from the scope of the invention. The shaft 104 may be constructed from one or more of a variety of materials, including metals, ceramics, polymers, composites, or wood. In some illustrative embodiments, the shaft 104, or at least portions thereof, may be constructed of a metal, such as stainless steel or titanium, or a composite, such as a carbon/graphite fiber-polymer composite. However, it is contemplated that the shaft 104 may be constructed of different materials without departing from the scope of the invention, including conventional materials that are known and used in the art. A grip element (not shown) may be positioned on the shaft 104 to provide a golfer with a slip resistant surface with which to grasp golf club shaft 104. The grip element may be attached to the shaft 104 in any desired manner, including in conventional manners known and used in the art (e.g., via adhesives or cements, threads or other mechanical connectors, swedging/swaging, etc.).

In general, the ball striking heads 102 according to the present invention include features on the body 108 that influence the impact of a ball on the face 112, such as one or more compression channels 140 positioned on the body 108 of the head 102 that allow at least a portion of the body 108 to flex, produce a reactive force, and/or change the behavior or motion of the face 112, during impact of a ball on the face 112. In one embodiment, at least a portion of the compression channel 140 is curved or bowed away from the outer periphery of the face 112. In the golf club 100 shown in FIGS. 1-4, the head 102 includes a single channel 140 located on the sole 118 of the head 102. As described below, this channel 140 permits compression and flexing of the body 108 during impact on the face 112, and can also produce a reactive force that can be transferred to the ball. This illustrative embodiment is described in greater detail below.

The golf club 100 shown in FIGS. 1-4 includes a compression channel 140 positioned on the sole 118 of the head 102, and which may extend continuously across at least a portion of the sole 118. In other embodiments, the head 102 may have a channel 140 positioned differently, such as on the crown 116, the heel 120, and/or the toe 122. It is also understood that the head 102 may have more than one channel 140, or may have an annular channel extending around the entire or substantially the entire head 102. As illustrated in FIGS. 1-4, the channel 140 of this example structure is elongated, extending between a first end 142 located proximate the heel 120 of the head 102 and a second end 144 located proximate the toe 122 of the head 102. The channel 140 has a boundary that is defined by a first or front edge 146 and a second or rear edge 148 that extend between the ends 142, 144. In this embodiment, the channel 140 extends adjacent to and along the bottom edge 115 of the face 112, and further extends into the heel 120 and toe 122 areas of the head 102. As seen in FIGS. 1-4, the channel 140 is substantially symmetrically positioned on the head 102 in this embodiment. In other embodiments, the channel 140 may be oriented and/or positioned differently. For example, the channel 140 may be oriented adjacent to a different edge of the face 112, and at least a portion of the channel 140 may be parallel or generally parallel to one or more of the edges of the face 112. The size and shape of the compression channel 140 also may vary widely without departing from this invention.

The channel 140 is recessed inwardly with respect to the immediately adjacent surfaces of the head 102 that extend from and/or are in contact with the edges 146, 148 of the channel 140, as shown in FIGS. 1-4. The channel 140 in this embodiment has a curved and generally semi-circular cross-sectional shape or profile, with a trough 150 and sloping, depending side walls 152 that are smoothly curvilinear, extending from the trough 150 to the respective edges 146, 148 of the channel 140. The trough 150 forms the deepest (i.e. most inwardly-recessed) portion of the channel 140 in this embodiment. It is understood that the channel 140 may have a different cross-sectional shape or profile, such as having a sharper and/or more polygonal (e.g. rectangular) shape in another embodiment. Additionally, the channel 140 may generally taper in depth so that the trough 150 has a greater depth at and around a center portion 130 of the channel 140 and is shallower at heel and toe portions 131, 132 of the channel 140. The channel 140 in the embodiment of FIGS. 1-4 generally extends around the edges of the sole 118 to some degree, although the deepest portion of the channel 140 (i.e. the trough 150) is located only near the front 124 of the head 102, and the rear portions of the channel 140 have a much shallower depth. Further, the channel 140 may have ridges or swales 158 located at the heel and toe portions 131, 132 of the channel 140. The ridges 158 generally define a boundary of the deepest portion of the channel 140 in the embodiment of FIGS. 1-4.

Additionally, in one embodiment, the wall thickness of the body 108 may be reduced at the channel 140, as compared to the thickness at other locations of the body 108, to provide for increased flexibility at the channel 140. In one embodiment, the wall thickness in the channel 140 is from 0.8-1.5 mm.

In the embodiment shown in FIGS. 1-4, the channel 140 is spaced from the bottom edge 115 of the face 112, with a spacing portion 154 defined between the channel 140 and the bottom edge 115. The spacing portion 154 is located immediately adjacent the channel 140 and junctures with one of the side walls 152 of the channel 140 along the front edge 146 of the channel 140, as shown in FIGS. 1-4. In this embodiment, the spacing portion 154 is oriented at an acute (i.e. <90°) angle to the ball striking surface 110 and extends rearward from the bottom edge 115 of the face 112 to the channel 140. Force from an impact on the face 112 can be transferred to the channel 140 through the spacing portion 154, as described below. In other embodiments, the spacing portion 154 may be oriented at a right angle or an obtuse angle to the ball striking surface 110, and/or the spacing portion 154 may be smaller than shown in FIGS. 1-4 or absent entirely. The spacing portion 154 is generally flattened in the embodiment of FIGS. 1-4. If desired, as another example, a smoothly curved surface may extend from the bottom edge 115 of the face 112 directly into the interior side walls 152 of the channel 140.

In one embodiment, the channel 140, or at least a portion thereof, is curved or bowed. The head 102 as illustrated in FIGS. 1-4 has a channel 140 that generally has a center portion 130 that is curved and bowed rearwardly, i.e. away from the face 112, and is spaced rearwardly a greater distance from the face 112 than adjacent portions of the channel 140. As seen in FIGS. 1 and 3, in this embodiment, the channel 140 has a heel portion 131 and a toe portion 132 that are spaced rearwardly approximately equal distances from the outer periphery of the face 112 and the center portion 130 that is spaced a greater distance from the face 112 than the heel or toe portions 131, 132. The center portion 130 in this embodiment is generally symmetrical and generally aligned with the geometric centerline of the body 108, however this arrangement and alignment may be different in other embodiments, depending at least in part on the geometry and symmetry of the body 108.

The front and rear edges 146, 148 of the channel 140 in the embodiment of FIGS. 1-4 are both curved and bowed away from the face 112. In this configuration, the edges 146, 148 are both spaced farther rearwardly from the face 112 at the center portion 130 as compared to opposed ends of each of the edges 146, 148, which may be located at the heel and toe portions 131, 132 and are positioned more closely to the periphery of the face 112. Additionally, the degrees of curving and bowing of the edges 146, 148 are slightly different in this embodiment, so that the width (measured in the front 124 to rear 126 direction) of the channel 140 is slightly larger at the center portion 130 and slightly narrower at the heel and toe portions 131, 132. In other embodiments, only one of the edges 146, 148 may be curved and/or bowed, and the width of the channel 140 may vary in a different manner, such as if one of the edges 146, 148 is curved and/or bowed to a much greater degree than the other. In another embodiment, the width of the channel 140 may be consistent and approximately equal from the heel portion 131 to the toe portion 132. In an alternate embodiment, one or both of the edges 146, 148 may be bowed toward the face 112, rather than away from the face 112. Further, the width (measured in the front 124 to rear 126 direction) of the spacing portion 154 also varies with the bowed front edge 146 of the channel 140, such that the width is greater at the center of the spacing portion 154 (proximate the center portion 130) and smaller proximate the heel portion 131 and the toe portion 132 of the channel 140. As seen in FIGS. 1 and 3, the width of the spacing portion 154 decreases by tapering from the center and becomes smaller toward the heel portion 131 and the toe portion 132 of the channel 140. The spacing portion 154 has the greatest width at approximately the geometric centerline of the body 108 and is generally symmetrical with respect to the geometric centerline in this embodiment as well. In other embodiments, the configuration of the spacing portion 154 may be different.

The deepest part of the channel 140, represented by the trough 150, also has a curved and bowed configuration in one embodiment, such as the embodiment shown in FIGS. 1-4. In this embodiment, the trough 150 has opposed ends (e.g. at the heel and toe portions 131, 132) that are more proximate to the periphery of the face 112 than the center of the trough 150 (e.g. at the center portion 130). Additionally, the trough 150 of the channel 140 in this embodiment is generally curved and bowed similarly to the front and rear edges 146, 148 of the channel 140, such that the trough 150 remains generally equidistant from the front and rear edges 146, 148 between the heel and toe portions 131, 132. In another embodiment, the side walls 152 of the channel 140 may be contoured differently, such that the trough 150 is curved and/or bowed differently. For example, in one configuration, one or both of the front and rear edges 146, 148 may be curved, while the trough 150 may not be curved, and in another configuration, the front and rear edges 146, 148 may not be curved, while the trough 150 may be curved. In a further configuration, the trough 150 may be curved and/or bowed in an opposite manner to one or both of the edges 146, 148. Still other configurations are possible.

In one embodiment, part or all of the channel 140 may have surface texturing or another surface treatment that affects the properties of the channel 140. For example, certain surface treatments, such as peening, coating, etc., may increase the stiffness of the channel and reduce flexing. As another example, other surface treatments may be used to create greater flexibility in the channel 140. As a further example, surface treatments may increase the smoothness of the channel 140 and/or the smoothness of transitions (e.g. the edges 146, 148) of the channel 140, which can influence aerodynamics, interaction with playing surfaces, visual appearance, etc. Further surface texturing or other surface treatments may be used as well.

The compression channel 140 of the head 102 shown in FIGS. 1-4 can influence the impact of a ball (not shown) on the face 112 of the head 102, as similarly described in U.S. patent application Ser. No. 13/015,264, filed Jan. 27, 2011, which is incorporated by reference herein in its entirety. In one embodiment, the channel 140 can influence the impact by flexing and/or compressing in response to the impact on the face 112, and/or by exerting a reaction force on the face 112 during impact. For example, when the ball impacts the face 112, the face 112 flexes inwardly. Additionally, some of the impact force is transferred through the spacing portion 154 to the channel 140, causing the sole 118 to flex at the channel 140. This flexing of the channel 140 may result in a smaller degree of deformation of the ball as compared to a traditional head, which can assist in achieving greater impact efficiency and greater energy and velocity transfer to the ball during impact. The more gradual impact created by the flexing also creates a longer impact time, which can also result in greater energy and velocity transfer to the ball during impact. Further, as the compressed channel 140 expands to return to its initial shape, a responsive or reactive force is exerted on the face 112, creating an increased "trampoline" effect, which can result in greater energy and velocity transfer to the ball during impact. Still further, because the channel 140 extends toward the heel 120 and toe 122, the head 102 can achieve increased energy and velocity transfer to the ball for impacts that are away from the center or traditional "sweet spot" of the face 112. It is understood that a channel 140 may be additionally or alternately incorporated into the crown 116 and/or sides 120, 122 of the body 108 in order to produce similar effects for energy and velocity transfer. For example, in one embodiment, the head 102 may have one or more channels 140 extending completely or substantially completely around the periphery of the body 108, such as shown in U.S. patent application Ser. No. 13/308,036, filed Nov. 30, 2011, which is incorporated by reference herein in its entirety. At least a portion of a channel 140 in this configuration may be curved or bowed away from the outer periphery of the face 112, as described above, and the channel 140 may have such curved/bowed portions on both the top 116 and the sole 118 in one embodiment. It is understood that the head 102 may have one or more channels 140 in a different configuration in other embodiments.

The curved and/or bowed configuration of the channel 140 may assist in controlling the flexing of the channel 140 and/or achieving a desired flexibility. For example, certain features of the head 102 (e.g. the access 128) may influence the flexibility of the channel 140, and the curved/bowed configuration of the channel 140 may assist in retaining the same flexibility as the channel 140 would have without the features in question. As another example, the curved/bowed configuration of the channel 140 may assist in achieving a desired flexibility for the channel 140, such as for a particular application. Other effects and properties may be achieved by channels 140 that are curved/bowed as shown in FIGS. 1-4 or in other configurations, and the configuration of the channel 140 may work in conjunction with other features to influence the flexibility of the channel 140.

Figure 5:
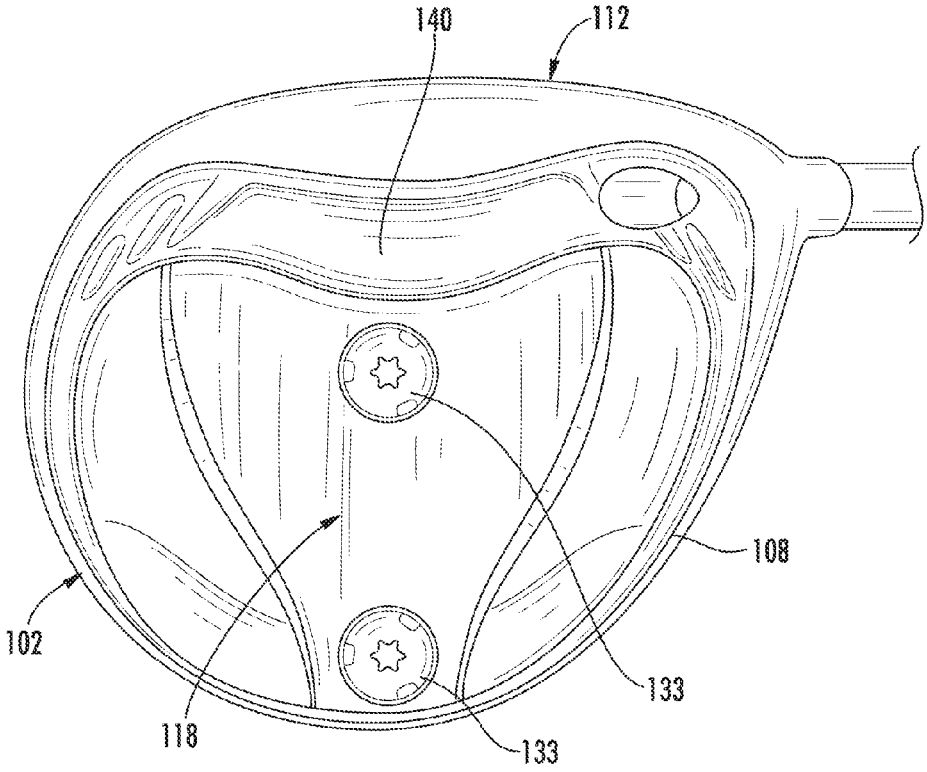
FIG. 5 is a bottom view of another embodiment of a ball striking device according to aspects of the present invention, in the form of a golf driver.
Figure 6:
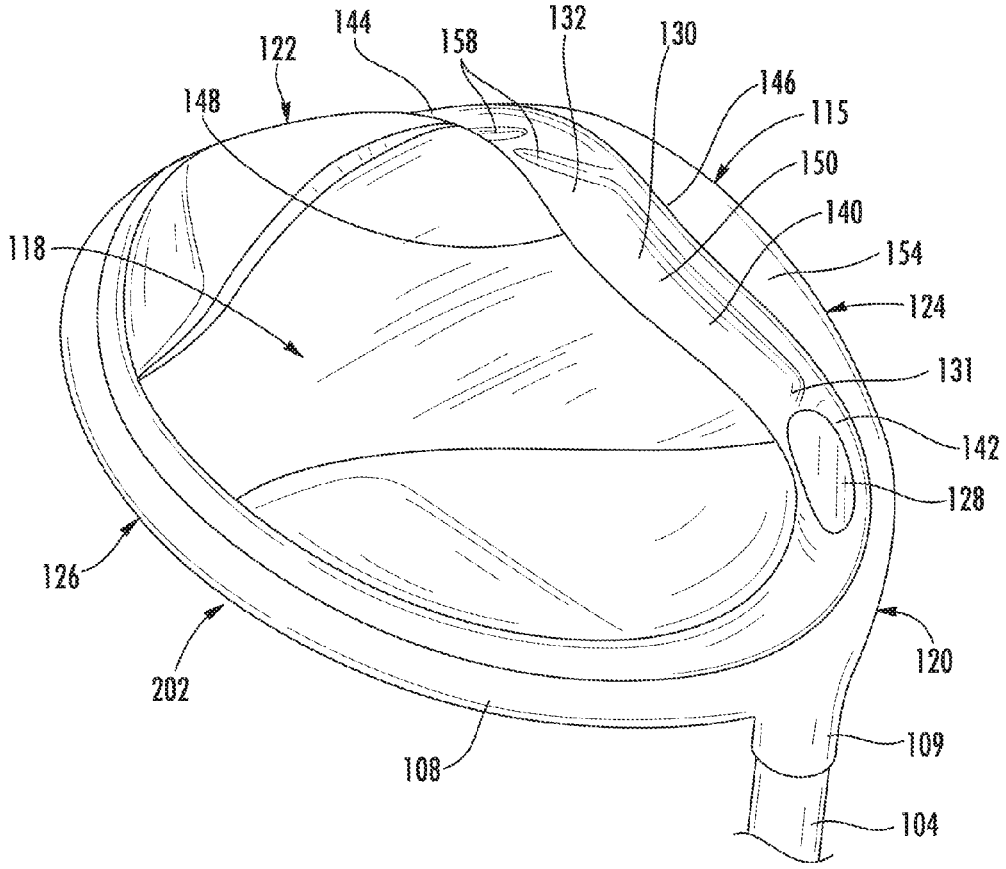
FIG. 6 is a bottom rear perspective view of another embodiment of a ball striking device according to aspects of the present invention, in the form of a golf fairway wood.
Figure 7:
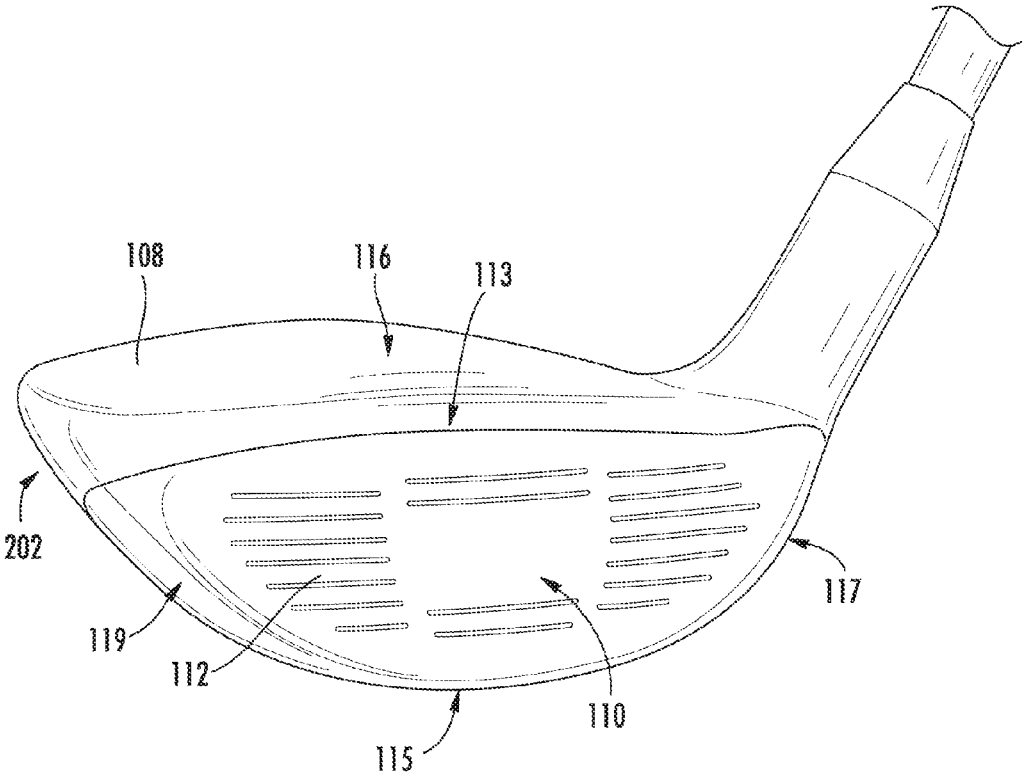
FIG. 7 is a top front perspective view of the ball striking device of FIG. 6.
Figure 8:
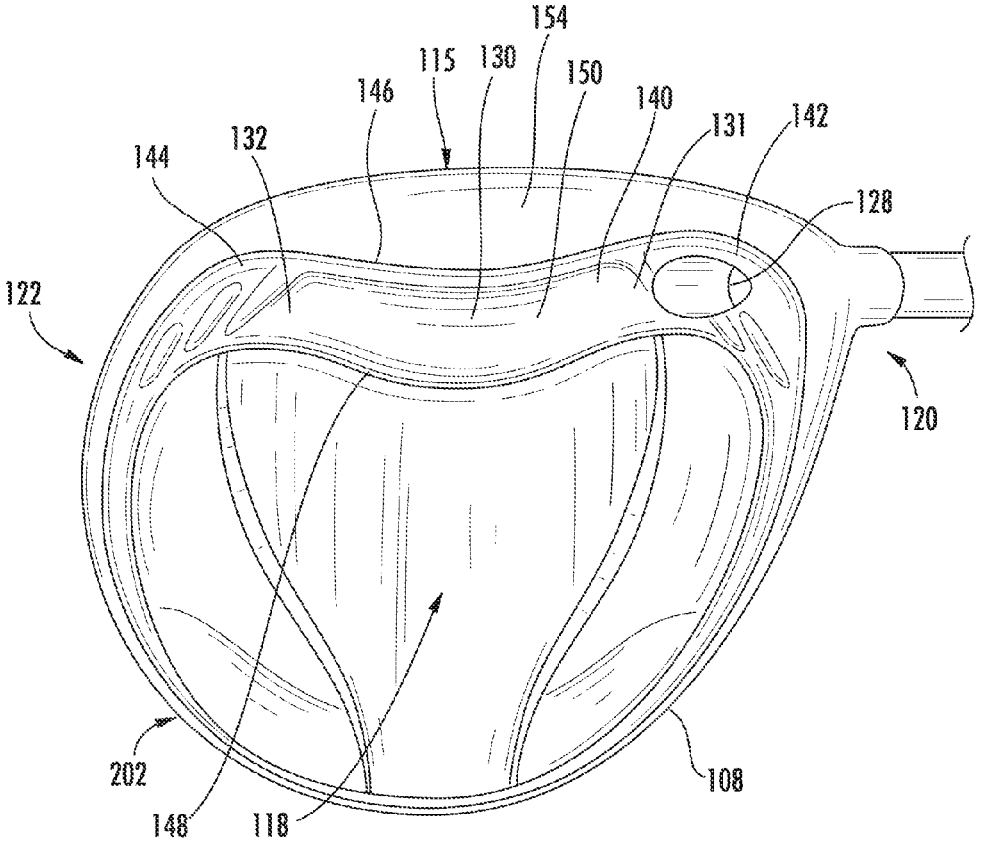
FIG. 8 is a bottom view of the ball striking device of FIG. 6.
Figure 9:
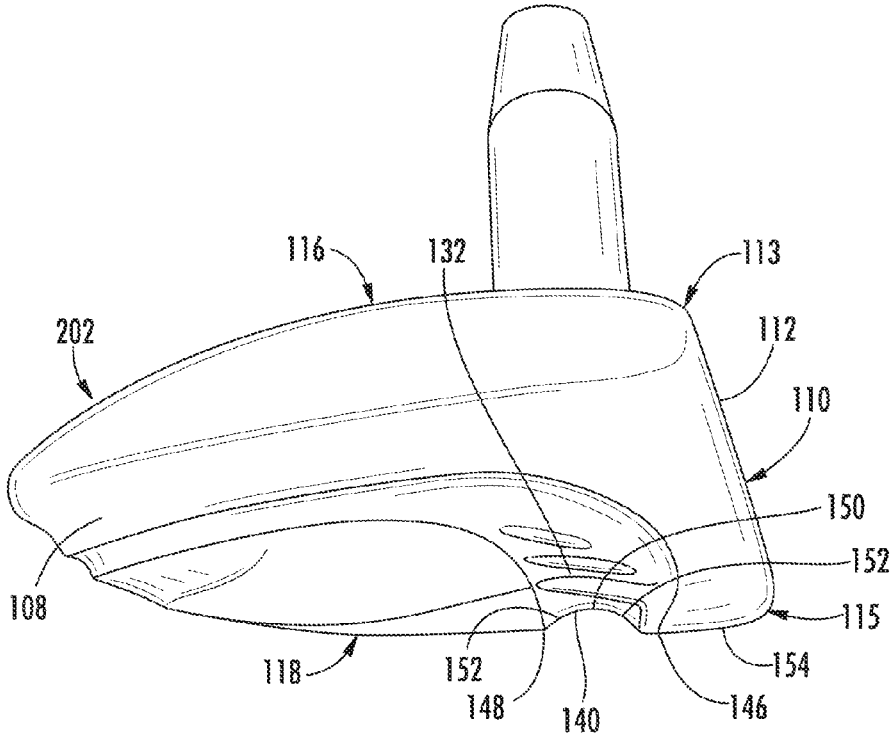
FIG. 9 is a side view of the ball striking device of FIG. 6.
Figure 10:
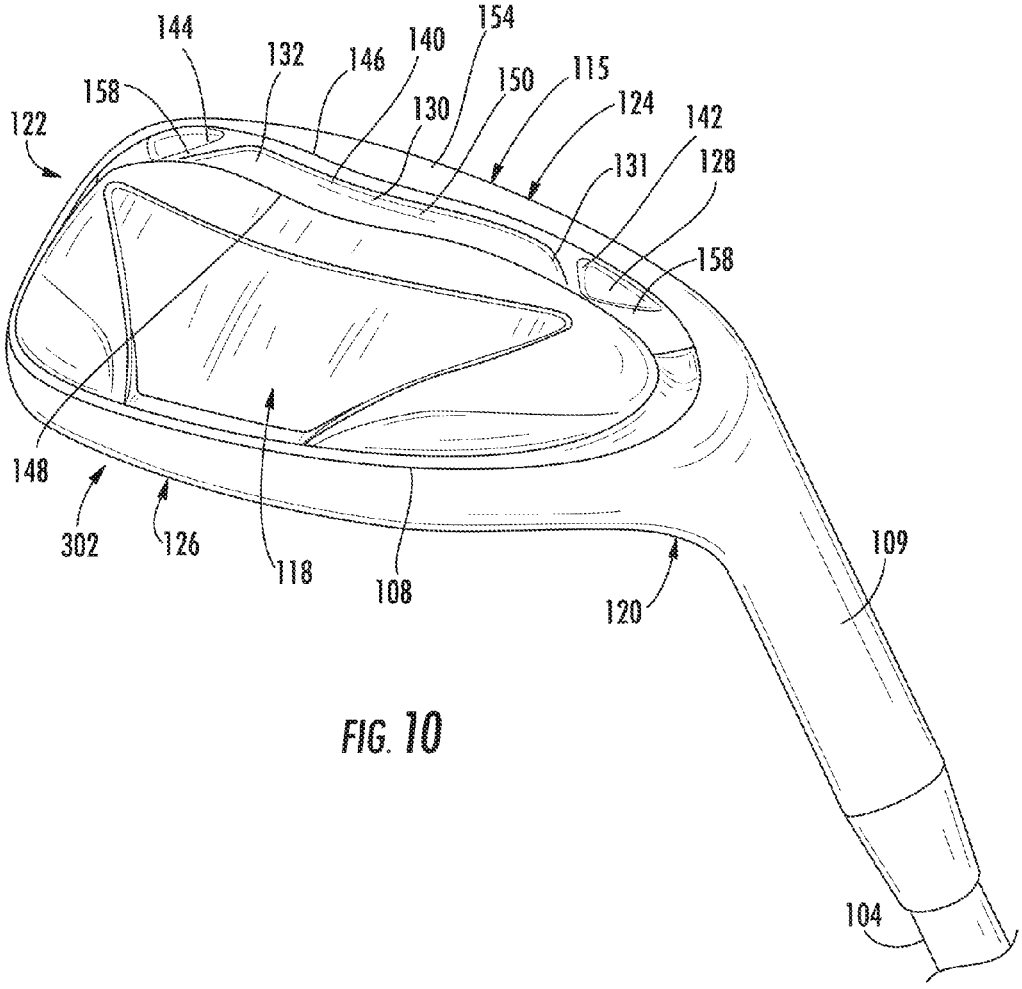
FIG. 10 is a bottom rear perspective view of another embodiment of a ball striking device according to aspects of the present invention, in the form of a golf hybrid.
Figure 11:
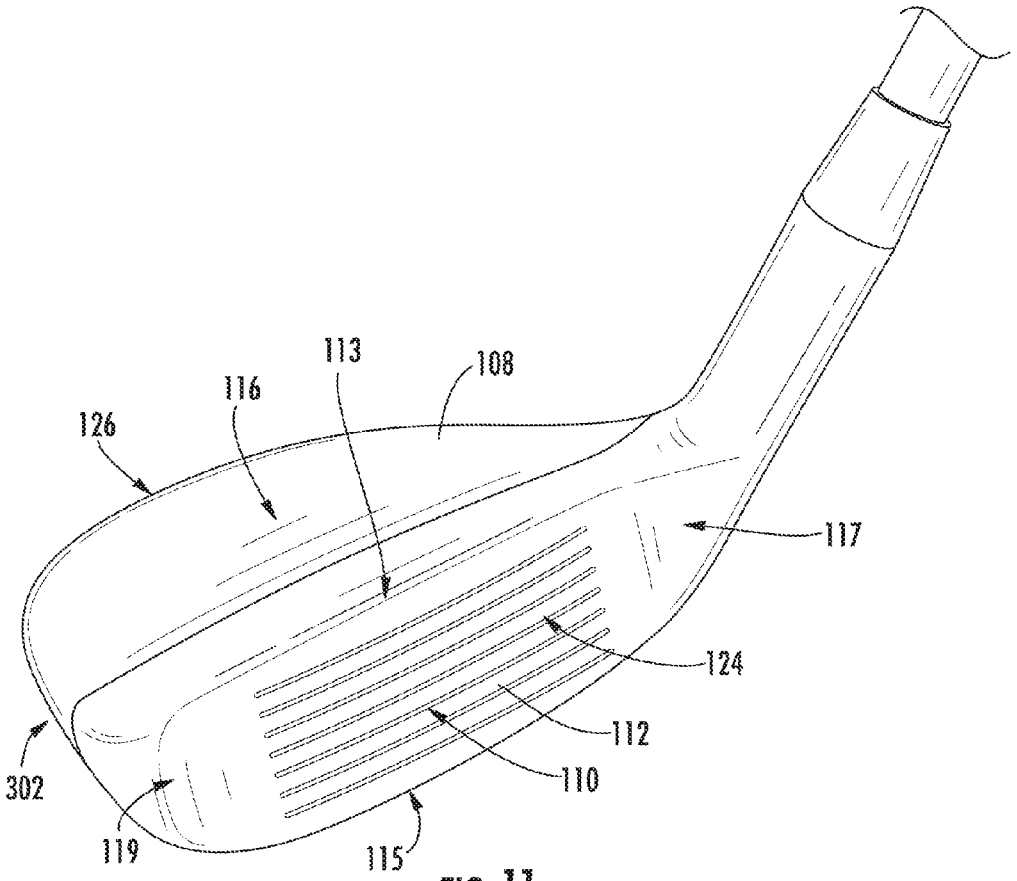
FIG. 11 is a top front perspective view of the ball striking device of FIG. 10.
Figure 12:
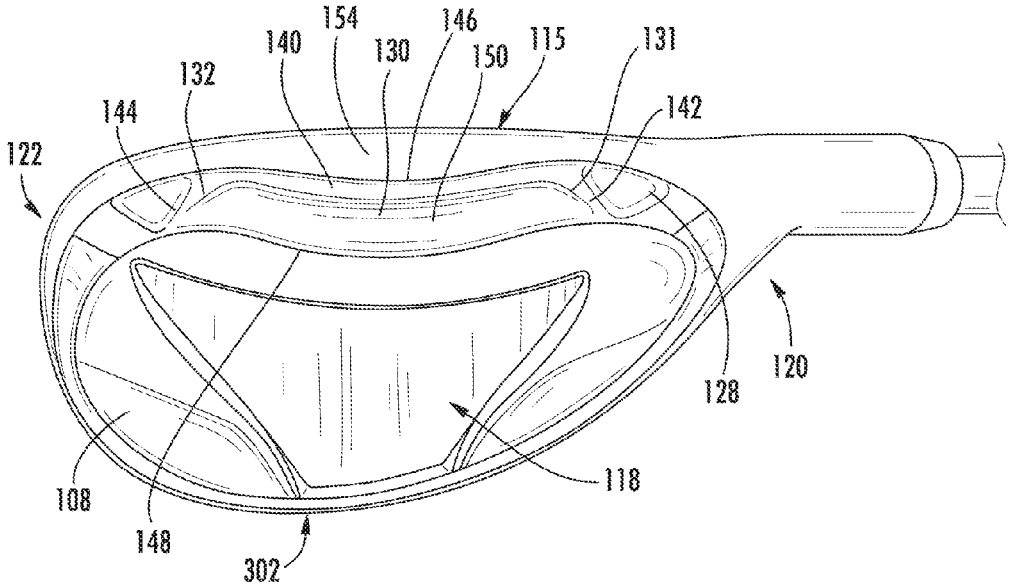
FIG. 12 is a bottom view of the ball striking device of FIG. 10.
Figure 13:
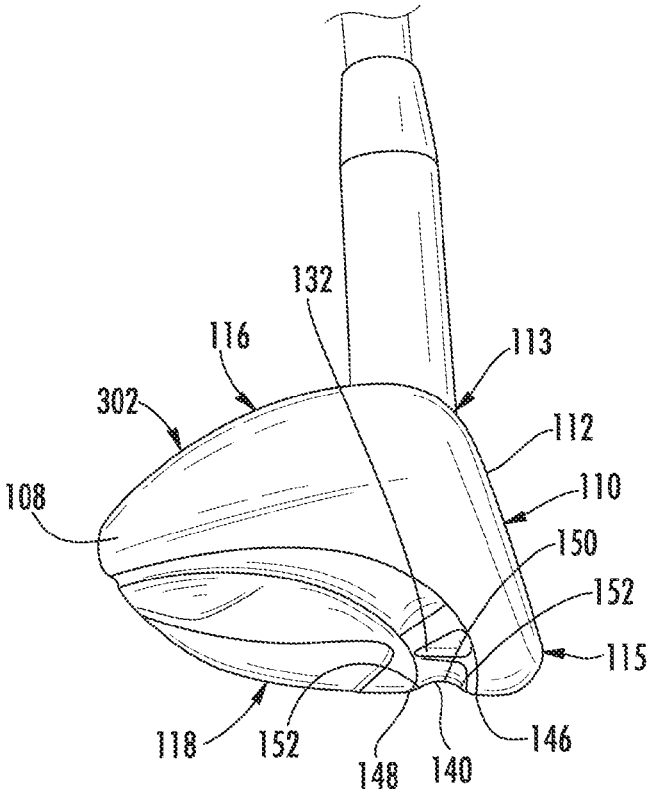
FIG. 13 is a side view of the ball striking device of FIG. 10.

In another embodiment, illustrated in FIG. 5, the head 102 may further include one or more weight members 133 located on the sole 118. These weight members 133 may be releasable and interchangeable, such as by having a snapping connection, a threaded connection, a locking connection (e.g. quarter-turn or half-turn), or other such connection, in order to permit interchanging of the weight members 133 with other weight members 133 having different weights. In another embodiment, the weight members 133 may be more permanently connected to the head 102. It is understood that such weight members permit selective weighting of the head 102, to achieve a desired weight and/or weight distribution.

FIGS. 6-9 illustrate another embodiment of a club head 202 according to aspects of the present invention, in the form of a fairway wood, having a channel 140 as described above with respect to the embodiment of FIGS. 1-4. FIGS. 10-13 illustrate another embodiment of a club head 302 according to aspects of the present invention, in the form of a hybrid club head, having a channel 140 as described above with respect to the embodiment of FIGS. 1-4. The heads 202, 302 in the embodiments of FIGS. 6-9 and FIGS. 10-13 generally have components and features that are similar to the head 102 as described above and shown in FIGS. 1-4, and such similar components and features are identified in FIGS. 6-13 using the same reference numerals as used above and in FIGS. 1-4. Additionally, such similar components and features may not be described again in detail for the sake of brevity. The heads 202, 302 in these embodiments may also produce some or all of the same benefits articulated herein with respect to the head 102 of FIGS. 1-4.

In general, the heads 202, 302 of FIGS. 6-13 each include a channel 140 that is curved and/or bowed as described above with respect to the channel 140 in the embodiment of FIGS. 1-4. The embodiments of FIGS. 6-13 each include a channel 140 that generally has a center portion 130 that is curved and bowed rearwardly, i.e. away from the face 112, and is spaced rearwardly a greater distance from the face 112 than adjacent portions of the channel 140, with heel and toe portions 131, 132 that are located closer to the face 112 than the center portion 130. In these embodiments, the front and rear edges 146, 148 and the trough 150 of each channel 140 are curved and bowed rearwardly, as similarly described above with respect to the channel 140 shown in FIGS. 1-4. Additionally, in the embodiments of FIGS. 6-13, the degrees of curving and bowing of the edges 146, 148 are slightly different, so that the width (measured in the front 124 to rear 126 direction) of each channel 140 is slightly larger at the center portion 130 and slightly narrower at the heel and toe portions 131, 132, as also similarly described above. Further, the spacing portion 154 in each of the embodiments of FIGS. 6-13 is wider proximate the center portion 130 and narrower proximate the heel and toe portions 131, 132 of the channel 140, as also similarly described above. It is understood that any of the variations, modifications, additional features, additional or alternate embodiments, etc., described above with respect to the head 102 of FIGS. 1-4 may be incorporated into the head 202 of FIGS. 6-9 or the head 302 of FIGS. 7-13.

Figure 14:
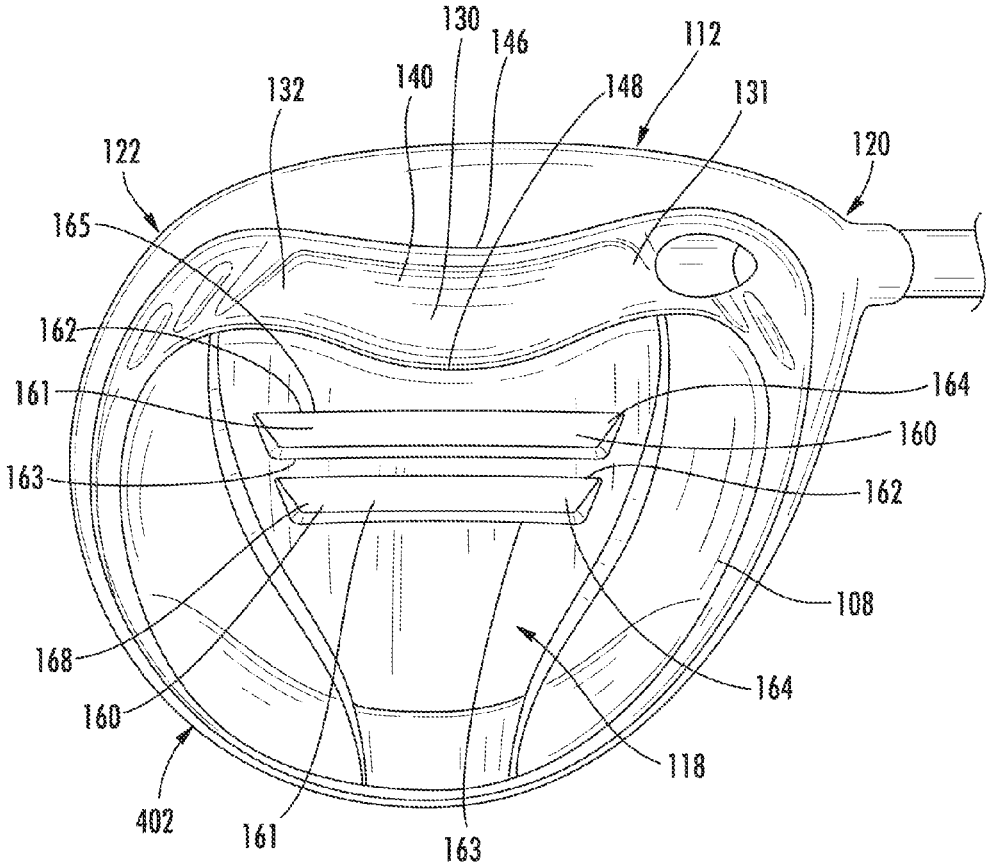
FIG. 14 is a bottom view of another embodiment of a ball striking device according to aspects of the present invention, in the form of a golf driver.
Figure 15:
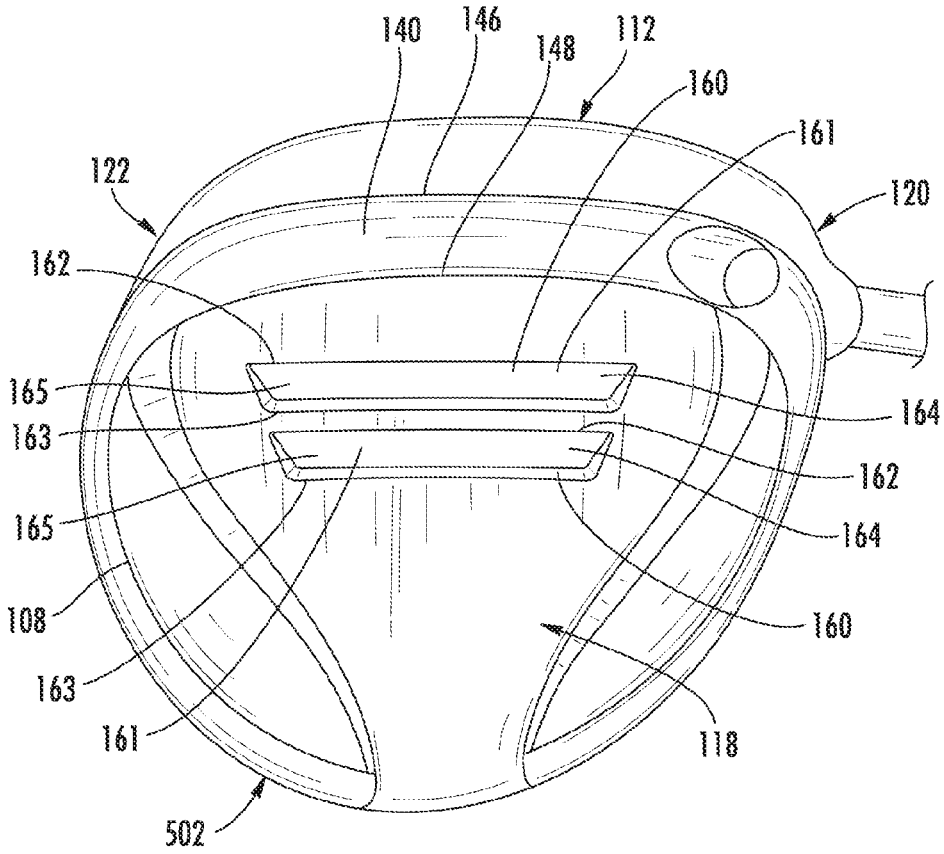
FIG. 15 is a bottom view of another embodiment of a ball striking device according to aspects of the present invention, in the form of a golf driver.

FIGS. 14 and 15 illustrate further embodiments of club heads 402, 502 according to aspects of the present invention, in the form of golf drivers. The heads 402, 502 include at least some components and features that are similar to the head 102 as described above and shown in FIGS. 1-4, and such similar components and features are identified in FIGS. 14-15 using the same reference numerals as used above and in FIGS. 1-4. Additionally, such similar components and features may not be described again in detail for the sake of brevity. The heads 402, 502 in these embodiments may also produce some or all of the same benefits articulated herein with respect to the head 102 of FIGS. 1-4.

The head 402 of FIG. 14 includes a channel 140 that is substantially the same as or identical to the channel 140 of the head 102 of FIGS. 1-4, and may include any of the features and components of the head 102 and the channel 140 described above, including any variations, modifications, additional features, additional or alternate embodiments, etc., described above. The head 502 of FIG. 15 includes a channel 140 that is similar to the channel 140 of FIGS. 1-4, but is generally parallel to the outer periphery of the face 112, including being generally parallel to at least the bottom edge 115 of the face 112. The head 502 of FIG. 15 may include any of the features and components of the head 102 and the channel 140 described above, including any variations, modifications, additional features, additional or alternate embodiments, etc., described above.

The heads 402, 502 of FIGS. 14-15 each include additional channels 160 located on the sole 118, spaced farther rearwardly from the compression channel 140 near the face 112.

Each of these additional channels 160 can influence the response, flexing, and other properties of the face 112 and may alter the response force exerted by the channel 140 on the face 112 during impact. In the embodiments of FIGS. 14-15, the additional channels 160 act as internal stiffening ribs to increase the stiffness of the sole 118 and control the flexing of the channel 140 to limit the degree of flexing of the channel 140 during impact. Further, the additional channels 160 may act to provide a foundational "base" for the channel 140, to focus flexing of the sole 118 at the channel 140, rather than other areas of the sole 118. In another embodiment, the head 402, 502 may have stiffening ribs similar to the additional channels 160 that project outwardly from the body 108, rather than inwardly. It is understood that the features of the heads 402, 502 of FIGS. 14-15, including the additional channels/stiffening ribs 160 and any variations, modifications, additional features, additional or alternate embodiments, etc., thereof, may be used in connection with the heads 202, 302 of FIGS. 6-13 or any other embodiments as described herein.

Each of the additional channels 160 in the embodiments of FIGS. 14-15 has an inwardly recessed trough 161 that is defined between a front edge 162 and a rear edge 163 that extend in the heel 120 to toe 122 direction, such that the additional channels 160 are elongated in the heel 120 to toe 122 direction. In this configuration, each of the additional channels 160 has a heel portion 164 on the side most proximate the heel 120 and a toe portion 165 on the side most proximate the toe 122. The first additional channel 160 (the second overall channel) is spaced rearwardly from the rear edge 148 of the channel 140, and the second additional channel 160 (the third overall channel) is spaced rearwardly from the rear edge 163 of the first additional channel 160. Additionally, in this embodiment, the front and rear edges 162, 163 of each of the additional channels 160 are relatively straight, and the additional channels 160 each have a trapezoidal or other polygonal outer shape. Further, in this embodiment, each of the additional channels 160 has a tapering depth that gradually increases from the front edge 162 to the rear edge 163, such that the maximum depth of the trough 161 is located proximate the rear edge 163. This tapering depth may give the additional channels 160 a polygonal cross-sectional shape as well. Still further, the additional channels 160 in this embodiment are substantially symmetrical with respect to a geometric centerline of the head 102 (e.g. extending in the front 124 to rear 126 direction). It is understood that the additional channels 160 may have different shapes, locations, orientations, and/or configurations in other embodiments, and that other embodiments may include a different number of additional channels 160.

Still other embodiments of compression channels 140 can be incorporated into a head 102 of the present invention. Further, it is understood that one or more different features of any of the heads 102, 202, 302, 402, 502 and the channels 140 described above with respect to FIGS. 1-15 can be combined in any combination in other embodiments.

Heads 102, et seq., incorporating the channels 140 disclosed herein may be used as a ball striking device or a part thereof. For example, a golf club 100 as shown in FIGS. 1-4 may be manufactured by attaching a shaft or handle 104 to a head that is provided, such as the heads 102, et seq., as described above. "Providing" the head, as used herein, refers broadly to making an article available or accessible for future actions to be performed on the article, and does not connote that the party providing the article has manufactured, produced, or supplied the article or that the party providing the article has ownership or control of the article. Additionally, a set of golf clubs including one or more clubs 100 having heads 102, et seq., as described above may be provided. In other embodiments, different types of ball striking devices can be manufactured according to the principles described herein. Additionally, the heads 102, et seq., golf club 100, or other ball striking device may be fitted or customized for a person, such as by attaching a shaft 104 thereto having a particular length, flexibility, etc., or by adjusting or interchanging an already attached shaft 104 as described above.

The ball striking devices and heads therefor as described herein provide many benefits and advantages over existing products. For example, the flexing of the sole 118 at the channel 140 results in a smaller degree of deformation of the ball, which in turn can result in greater impact efficiency and greater energy and velocity transfer to the ball during impact. As another example, the more gradual impact created by the flexing can create a longer impact time, which can also result in greater energy and velocity transfer to the ball during impact. As a further example, the responsive or reactive force exerted on the face 112 as the compressed channel 140 expands to return to its initial shape is imparted to the ball, which can result in greater energy and velocity transfer to the ball during impact. Still further, because the channel 140 extends toward the heel and toe edges 117, 119 of the face 112, the head 102, et seq., can achieve increased energy and velocity transfer to the ball for impacts that are away from the center or traditional "sweet spot" of the face 112. As an additional example, the features described herein may result in improved feel of the golf club 100 for the golfer, when striking the ball. Additionally, the configuration of the channel 140 may work in conjunction with other features (e.g. the additional channels 160, the access 128, etc.) to influence the overall flexibility and response of the channel 140, as well as the effect the channel 140 has on the response of the face 112. Further benefits and advantages are recognized by those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A ball striking device comprising:

a face having a striking surface configured for striking a ball, the face being defined by an outer periphery;

a body connected to the face and extending rearwardly from the outer periphery of the face, the body having a sole configured to face a playing surface, a crown opposite the sole, a heel, and a toe, wherein the head has a geometric centerline extending across the body in a front-to-rear direction;

a hosel connected to the body proximate the heel, the hosel having internal interconnection structure adapted for connection of a shaft to the hosel;

an inwardly recessed channel extending across at least a portion of the sole of the body, wherein the channel comprises an inwardly recessed trough defined between a front edge and a rear edge extending in the heel-toe direction, and wherein the channel extends on the sole across the geometric centerline, such that portions of the channel are positioned on heel and toe sides of the geometric centerline; and an access opening extending through the sole and intersecting the channel, the access opening providing access to the internal interconnection structure of the hosel.

2. The ball striking device of claim 1, wherein the internal interconnection structure is adapted for connection of the shaft to the hosel in an adjustable configuration.

3. The ball striking device of claim 1, wherein the access opening is located between the front edge and the rear edge of the channel.

4. The ball striking device of claim 1, wherein the access opening intersects a heel portion of the channel.

5. The ball striking device of claim 4, wherein the internal interconnection structure is adapted for connection of the shaft to the hosel in an adjustable configuration.

6. The ball striking device of claim 1, further comprising a stiffening rib on the sole, spaced rearwardly from the channel, wherein the stiffening rib increases the stiffness of the sole.

7. The ball striking device of claim 6, wherein the stiffening rib projects inwardly into the body.

8. The ball striking device of claim 1, wherein the access opening influences a flexibility of the channel.

9. A golf club comprising the ball striking device of claim 1 and a shaft connected to the hosel via the internal interconnection structure.

10. A ball striking device comprising:

a face having a striking surface configured for striking a ball, the face being defined by an outer periphery;

a body connected to the face and extending rearwardly from the outer periphery of the face, the body having a sole configured to face a playing surface, a crown opposite the sole, a heel, and a toe, wherein the head has a geometric centerline extending across the body in a front-to-rear direction;

internal interconnection structure adapted for connection of a shaft to the body in an adjustable configuration;

a channel extending across at least a portion of the sole of the body, wherein the channel is defined between a front edge and a rear edge extending in the heel-toe direction and is inwardly recessed between the front and rear edges, and wherein the channel extends on the sole across the geometric centerline, such that portions of the channel are positioned on heel and toe sides of the geometric centerline; and an access opening within the sole, the access opening providing access to the internal interconnection structure, wherein the access opening is in communication with the channel.

11. The ball striking device of claim 10, wherein the access opening is located between the front edge and the rear edge of the channel.

12. The ball striking device of claim 10, wherein the access opening is in communication with a heel portion of the channel.

13. The ball striking device of claim 10, further comprising a stiffening rib on the sole, spaced rearwardly from the channel, wherein the stiffening rib increases the stiffness of the sole.

14. The ball striking device of claim 13, wherein the stiffening rib projects inwardly into the body.

15. The ball striking device of claim 10, wherein the access opening influences a flexibility of the channel.

16. A golf club comprising the ball striking device of claim 10 and a shaft adjustably connected to the ball striking device via the internal interconnection structure.

17. A ball striking device comprising:

a face having a striking surface configured for striking a ball, the face being defined by an outer periphery;

a body connected to the face and extending rearwardly from the outer periphery of the face, the body having a sole configured to face a playing surface, a crown opposite the sole, a heel, and a toe, wherein the head has a geometric: centerline extending across the body in a front-to-rear direction;

internal interconnection structure adapted for connection of a shaft to the body;

a channel extending across at least a portion of the sole of the body, wherein the channel is defined between a front edge and a rear edge extending in the heel-toe direction and is inwardly recessed between the front and rear edges, wherein the channel extends on the sole across the geometric centerline, such that portions of the channel are positioned on heel and toe sides of the geometric centerline;

an access opening extending through the sole and intersecting the channel, the access opening providing access to the internal interconnection structure; and a stiffening rib on the sole, spaced rearwardly from the channel, wherein the stiffening rib increases the stiffness of the sole.

18. The ball striking device of claim 17, wherein the stiffening rib projects inwardly into the body.

19. The ball striking device of claim 17, further comprising multiple stiffening ribs on the sole, spaced rearwardly from the channel, wherein each stiffening rib increases the stiffness of the sole.

20. The ball striking device of claim 19, wherein each stiffening rib projects inwardly into the body.

21. The ball striking device of claim 17, wherein the internal interconnection structure is adapted for connection of the shaft to the body in an adjustable configuration.

22. The ball striking device of claim 17, wherein the access opening is located between the front edge and the rear edge of the channel.

23. The ball striking device of claim 17, further comprising a hosel connected to the body proximate the heel, the hosel containing the internal interconnection structure, wherein the access opening intersects a heel portion of the channel.

24. The ball striking device of claim 23, wherein the internal interconnection structure is adapted for connection of the shaft to the hosel in an adjustable configuration.

25. The ball striking device of claim 17, wherein the rear edge of the channel is spaced rearwardly a greater distance from the outer periphery of the face at a center portion of the channel as compared to a point proximate the toe.

26. A golf club comprising the ball striking device of claim 17 and a shaft connected to the body via the internal interconnection structure.

27. A ball striking device comprising:

a face having a striking surface configured for striking a ball, the face being defined by an outer periphery;

a body connected to the face and extending rearwardly from the outer periphery of the face, the body having a sole configured to face a playing surface, a crown opposite the sole, a heel, and a toe;

a hosel connected to the body proximate the heel, the hosel having internal interconnection structure adapted for connection of a shaft to the hosel;

an inwardly recessed channel extending across at least a portion of the sole of the body, wherein the channel comprises an inwardly recessed trough defined between a front edge and a rear edge extending in the heel-toe direction; and an access opening extending through the sole and intersecting the channel, the access opening providing access to the internal interconnection structure of the hosel, wherein the rear edge of the channel is spaced rearwardly a greater distance from the outer periphery of the face at a center portion of the channel as compared to a point proximate the toe.

28. The ball striking device of claim 27, wherein the access opening intersects a heel portion of the channel, and wherein the internal interconnection structure is adapted for connection of the shaft to the hosel in an adjustable configuration.

29. The ball striking device of claim 28, further comprising a stiffening rib on the sole, spaced rearwardly from the channel, wherein the stiffening rib increases the stiffness of the sole.

30. A ball striking device comprising:

a face having a striking surface configured for striking a ball, the face being defined by an outer periphery;

a body connected to the face and extending rearwardly from the outer periphery of the face, the body having a sole configured to face a playing surface, a crown opposite the sole, a heel, and a toe;

internal interconnection structure adapted for connection of a shaft to the body in an adjustable configuration;

a channel extending across at least a portion of the sole of the body, wherein the channel is defined between a front edge and a rear edge extending in the heel-toe direction and is inwardly recessed between the front and rear edges; and an access opening within the sole, the access opening providing access to the internal interconnection structure, wherein the access opening is in communication with the channel, wherein the rear edge of the channel is spaced rearwardly a greater distance from the outer periphery of the face at a center portion of the channel as compared to a point proximate the toe.

31. The ball striking device of claim 30, wherein the access opening is in communication with a heel portion of the channel and is located between the front edge and the rear edge of the channel.

32. The ball striking device of claim 31, further comprising a stiffening rib on the sole, spaced rearwardly from the channel, wherein the stiffening rib increases the stiffness of the sole.

33. A ball striking device comprising:

a face having a striking surface configured for striking a ball, the face being defined by an outer periphery;

a body connected to the face and extending rearwardly from the outer periphery of the face, the body having a sole configured to face a playing surface, a crown opposite the sole, a heel, and a toe;

internal interconnection structure adapted for connection of a shaft to the body;

a channel extending across at least a portion of the sole of the body, wherein the channel is defined between a front edge and a rear edge extending in the heel-toe direction and is inwardly recessed between the front and rear edges;

an access opening extending through the sole and intersecting the channel, the access opening providing access to the internal interconnection structure;

a stiffening rib on the sole, spaced rearwardly from the channel, wherein the stiffening rib increases the stiffness of the sole; and a hosel connected to the body proximate the heel, the hosel containing the internal interconnection structure, wherein the access opening intersects a heel portion of the channel, wherein the internal interconnection structure is adapted for connection of the shaft to the hosel in an adjustable configuration, and wherein the rear edge of the channel is spaced rearwardly a greater distance from the outer periphery of the face at a center portion of the channel as compared to a point proximate the toe.

34. A ball striking device comprising:

a face having a striking surface configured for striking a ball, the face being defined by an outer periphery;

a body connected to the face and extending rearwardly from the outer periphery of the face, the body having a sole configured to face a playing surface, a crown opposite the sole, a heel, and a toe;

internal interconnection structure adapted for connection of a shaft to the body;

a channel extending across at least a portion of the sole of the body, wherein the channel is defined between a front edge and a rear edge extending in the heel-toe direction and is inwardly recessed between the front and rear edges;

an access opening extending through the sole and intersecting the channel, the access opening providing access to the internal interconnection structure; and a stiffening rib on the sole, spaced rearwardly from the channel, wherein the stiffening rib increases the stiffness of the sole, wherein a center portion of the channel has a greater flexibility than the stiffening rib.

* * * * *